US005395001A

United States Patent [19]

Moore

[11] Patent Number: 5,395,001

[45] Date of Patent: Mar. 7, 1995

[54] SUPPORTING SPACER FOR SELF-SEALING CENTRIFUGE TUBES

[75] Inventor: Patrick O. Moore, Gilroy, Calif.

[73] Assignee: Beckman Instruments, Inc., Fullerton, Calif.

[21] Appl. No.: 42,310

[22] Filed: Apr. 2, 1993

[51] Int. Cl.[6] ..... B04B 15/00

[52] U.S. Cl. ..... 215/364; 494/16

[58] Field of Search ..... 215/364, 274, 277, 364; 494/16, 20, 45, 26; 422/102

[56] References Cited

U.S. PATENT DOCUMENTS

| | | | |
|---|---|---|---|
| 2,172,544 | 9/1939 | Panter | 215/364 X |
| 3,071,316 | 1/1963 | Piemonte et al. | 233/26 |
| 3,265,296 | 8/1966 | Mitchell | 494/16 |
| 3,366,320 | 1/1968 | Cho | 494/16 |
| 3,465,957 | 9/1969 | Brandt | 494/16 |
| 4,290,550 | 9/1981 | Chulay et al. | 494/16 X |
| 4,301,963 | 11/1981 | Nielsen | 494/16 |
| 4,304,356 | 12/1981 | Chulay et al. | 494/16 X |
| 4,690,670 | 9/1987 | Nielsen | 494/16 |
| 5,127,895 | 7/1992 | Pawlovich | 494/16 |

FOREIGN PATENT DOCUMENTS

| | | | |
|---|---|---|---|
| 9218390 | 10/1992 | WIPO | 494/16 |

*Primary Examiner*—Steven M. Pollard
*Attorney, Agent, or Firm*—William H. May; Gary T. Hampson; Thomas Schneck

[57] ABSTRACT

The present invention is directed to a floating cap or spacer and centrifuge tube assembly which provide adequate resistance to the deforming forces exerted on it. The exterior wall of the tube stem is provided with an annular ridge and the support spacer is provided with an annular groove which mates with the ridge on the tube stem to form an interlocking coupling.

12 Claims, 2 Drawing Sheets

SUPPORTING SPACER FOR SELF-SEALING CENTRIFUGE TUBES

BACKGROUND OF THE INVENTION

1. Field of the Invention

The present invention relates to centrifugation, and particularly to the sample retaining means used in connection with a centrifuge rotor.

2. Description of Related Art

The invention of OptiSeal TM centrifuge tubes (commercialized by Beckman Instruments Inc., U.S.A.) is disclosed in U.S. Pat. No. 5,127,895, entitled "SelfSeal Centrifuge Tube", assigned to the assignee of the present invention. OptiSeal TM tubes are thin-walled vessels which are sealed using plugs under forces developed by centrifuge operation. The particular geometry of the OptiSeal TM tube illustrated and described in the '895 patent has a hemispherical top portion around the tube stem. Such tubes are primarily designed for use in vertical tube rotors (in which axis of each tube cavity is parallel to the rotor spin axis) and near vertical tube rotors (in which axis of each tube cavity is at a small oblique angle on the order of 10° to the rotor spin axis). A support cap or spacer is secured to a counterbore in the cavity and engages the top of the tube. The advantages of the spacer are that it supports against the top portion of the tube and the plug so that it prevents deformation of the tube top caused by centrifugally induced hydrostatic pressure and it provides support to seal the plug to the cube stem against the internal the hydrostatic pressure.

However, while the patented tube and closure have been found to be effective in maintaining a seal under high centrifugal forces when applied to a vertical tube rotor and near vertical tube rotors, the disclosed support spacer might not be adequate to prevent deformation of the tube near the tube stem when applied to fixed angle rotors and swinging bucket rotors. It has been found that the upper portion of the tube around the tube stem or opening of the tube may be deformed in fixed angle rotors (in which each rotor cavity is inclined at a large angle on the order of 25° to the rotor spin axis), or buckle the tube in the axial direction in swinging bucket rotor applications (in which the centrifuge tubes are pivotally supported on the rotor to allow the axis of the tubes to swing outwards towards horizontal upon centrifugation). Tube deformation is more pronounced when there is significant amounts of air enclosed in the tube, from air either entrained in the liquid material or left in the tube because the liquid does not fill it as a result of limitation in the tube filling procedures.

SUMMARY OF THE INVENTION

The present invention is directed to a floating cap or spacer and centrifuge tube assembly which provide adequate resistance to the deforming forces exerted on it. The exterior wall of the tube stem is provided with an annular ridge and the support spacer is provided with an annular groove which mates with the ridge on the tube stem to form an interlocking coupling.

In the described embodiment, OptiSeal TM tube and cooperative floating spacer are modified with such interlocking coupling. In operation, the tube is first sealed with a plug and the floating spacer is coupled to the tube stem by a snap action. The spacer surrounds the tube stem and allows the plug to extend beyond the top of the spacer. Because of the interlocking structure, the plug is securely retained in the tube stem, while deformation of the tube is controlled.

For fixed angle rotor applications, the spacer supports also the top of the plug. The tubes to be used in the fixed angle rotors are preferred to have a bell-shaped top portion. This configuration results in a lower center of gravity of the spacer with respect to the center of gravity of the tube stem and the centers of gravity being closer together, thus eliminating or decreasing the effect of rotational torque about the tube stem caused by radial forces on the spacer.

DESCRIPTION OF THE ILLUSTRATED EMBODIMENTS

The following description is of the best presently contemplated mode of carrying out the invention. This description is made for the purpose of illustrating the general principles of the invention and should not be taken in a limiting sense. The scope of the invention is best determined by reference to the appended claims.

The advantages of the present invention are primarily intended for use in fixed angle centrifuge rotors and swinging bucket rotors. However, the invention may also be useful in conjunction with centrifuge rotors having vertical sample-containing cavities. Furthermore, the present invention appears to have its primary advantages in conjunction with the use of modified OptiSeal TM sample containing centrifuge tubes. Such tubes have proven to be highly advantageous in respect to sealing of the tubes. It is however understood that tubes of other geometries may take advantage of the present invention to various extent.

Figure 1:
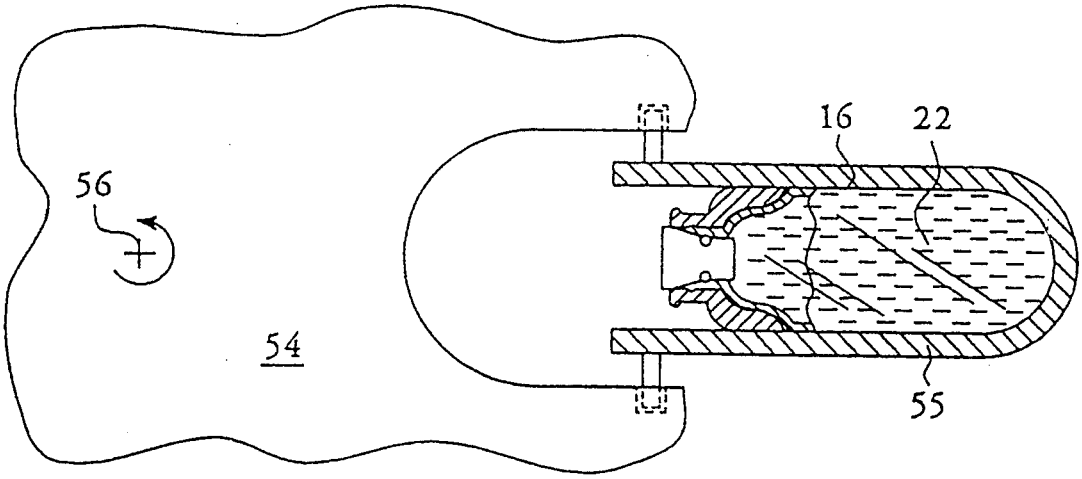
FIG. 1 is a schematic top view of a swinging bucket centrifuge rotor supporting the tube and spacer assembly in accordance with one embodiment of the present invention.

FIG. 1 shows a schematic top view of a swinging bucket rotor 54 having several buckets 55 pivotally supported circumferentially around a spin axis 56. A centrifuge tube 16 is supported in the bucket 55, which upon centrifugation swings towards the horizontal.

Figure 2:
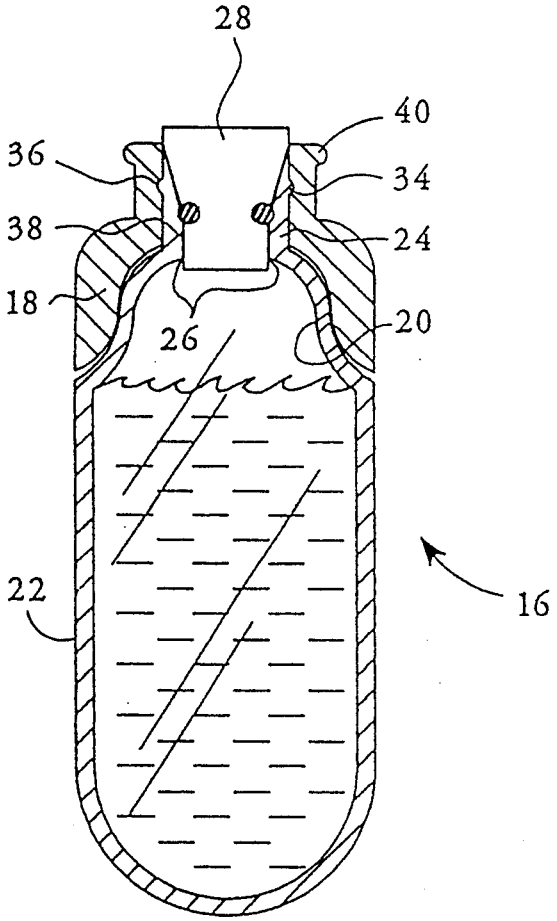
FIG. 2 is an enlarged sectional view of a centrifuge tube and a closure assembly in accordance with one embodiment of the present invention.

With the exception of the improvements in accordance with the present invention, the tube 16 is similar in other aspects to the "OptiSeal TM" tube of the type disclosed and explained in detail in U.S. Pat. No. 5,127,895 (incorporated by reference herein), and improvement thereof disclosed in U.S. patent application No. 08/042,352 filed concurrently herewith and commonly assigned to the assignee of the present invention. Referring also to FIG. 2, unlike the prior art OptiSeal TM tube, the top portion 20 of the tube 16 is bell-shaped as shown. The top portion 20 is formed integrally with its body portion 22 by a suitable process, such as blow molding. In the center of the top portion 20 of the tube 16 is a tube stem 24 extending therefrom. The interior of the stem 24 defines a conically tapered opening 26 which widens outward from the tube. The stem 24 is integrally formed with the top portion 20 of the tube. The tube 16 can be made from a thermoplastic material preferably having a translucent or transparent characteristic. Polypropylene or suitable polyolefin are acceptable materials.

Figure 3:
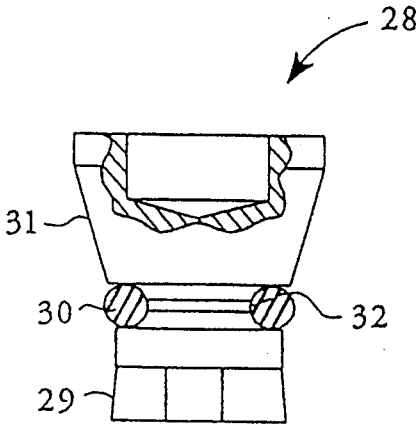
FIG. 3 is a sectional view illustrating more clearly the plug to be used with a centrifuge tube to take advantage of the spacer of the present invention.
Figure 4:
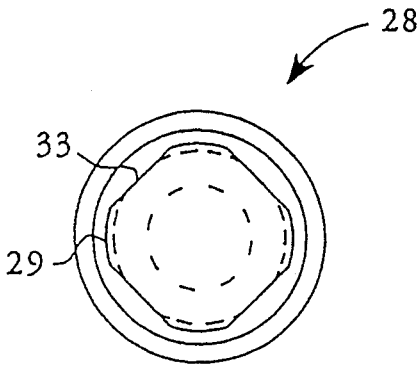
FIG. 4 is a bottom end view of the plug of FIG. 3.

A plug 28 is used to seal the opening 26. The plug 28 can be made from polyphenylene oxide, Noryl TM or other similar material. Referring also to FIGS. 3 and 4, the plug 28 comprises a conically tapered body 31 having an O-ring 30 retained in an annular groove 32. The taper of the plug 28 is approximately the same as that of the tube stem opening 26. The O-ring 30 protrudes above the tapered surface of the plug 28. When the plug is inserted into the opening of the tube stem, the O-ring 30 comes into sealing contact with the tapered interior surface of the tube stem 24. The plug 28 has a flared end 29 having flat portions 33 around its circumference. The flared end 29 fits through the constricted diameter of the tube opening 25 of FIG. 1 and latches onto the base of the tube stem 24 with a snap action. The amount of force required to insert and remove the plug 28 depends in part on the interference between the plug 28 and the tube stem 24, which depends in part on the extent of flat portions 33. The copending patent application No. 08/042,352 discloses in greater details the use of this plug in relation to the centrifuge tube.

Referring again to FIG. 1, the exterior of the stem 24 of the centrifuge tube 20 is generally cylindrical. An annular ridge 34 having a semi-circular cross-section is provided at about mid-length of the tube stem 24. In accordance with the present invention, a floating spacer 18 is provided with a matching annular groove 36 for receiving the ridge 34. The spacer floats to the extent to maintain supporting engagement with the top of the tube. The spacer is free to slide along the rotor cavity without restriction other than friction and the presence of the tube. The spacer 18 has a central through opening 38 which is of clearance fit with respect to the tube stem 24 except for the annular ridge 34. The annular ridge 34 forms an interlocking structure with the groove 36 in the spacer 18 when the spacer is fitted onto the tube stem 24. The top of the spacer has an annular flange 40. This flange 40 not only provides a gripping structure for an extraction device for the tube and spacer assembly, but also provides hoop reinforcement to the top of the spacer 18 during centrifugation. The spacer is of a height which allows the tube stem 24 to extend beyond the top of the spacer 18. This results in smaller and therefore less massive structure than the spacer described in the '895 U.S. Patent. The bell-shaping of the tube conforming surface forms a structure which requires less material, thus less massive, as compared to a spacer having a hemi-spherical surface. Less spacer mass results in less tendency for tube deformation from the centrifugal pressure of the spacer on the tube.

In operation, the plug 28 is inserted into the filler stem opening 26 followed by attaching the spacer 18 onto the tube stem 24 with a snap action. The plug 28 is restricted from loosening from the tube stem 24 once the spacer 18 is in place. Specifically, the tube stem 24 is prevented from deforming to allow the flared end 29 of the plug 28 to withdraw past the constricted diameter in the tube stem 24. The entire tube assembly is then inserted into the bucket for centrifugation. During centrifugation, centrifugal force acts radially outward to tend to swing the bucket outwards towards a horizontal position as shown in FIG. 1. The spacer 18 loads against the top portion 20 of the centrifuge tube 16 to provide support. The interlocking coupling between the ridge 34 and groove 36 ensures that the tube stem 24 does not collapse or buckle in the axial direction when used in a swinging bucket rotor, despite the presence of an air pocket in the tube 16 directly below the tube stem 24.

Post centrifugation, the spacer and tube assembly can be removed from the rotor cavity by use of a suitable extraction device (not shown, e.g. a tweezers as disclosed in copending application (attorney docket no. 8D-1158) pulling on the flange 40 provided on the top of the spacer 18. The spacer 18 can be removed from the tube stem 24 by simply twisting and pulling the spacer off the tube stem; no additional tool is required.

The bell-shaping of the spacer 18 concentrates the majority of deformation in that area thereby reducing the wedging effect and lowering the extraction force necessary to remove the tube from the rotor. In other words, the bell-shaping allows control of location of deformation, since deformation cannot be prevented. The interlocking coupling between the spacer 18 and the tube stem 24 ensures that the spacer and tube assembly remains intact during the extraction of the tube from the rotor, thereby ensuring that the plug 28 remain sealed to the tube stem 24.

Figure 5:
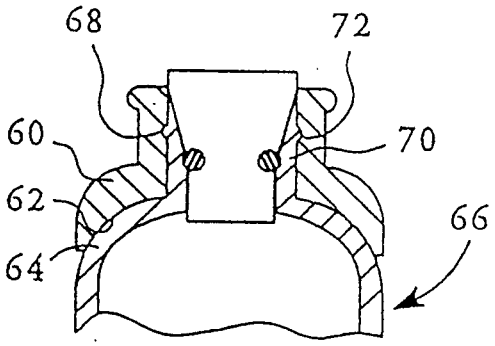
FIG. 5 is a sectional view showing another spacer and tube in accordance with another embodiment of the present invention.
Figure 6:
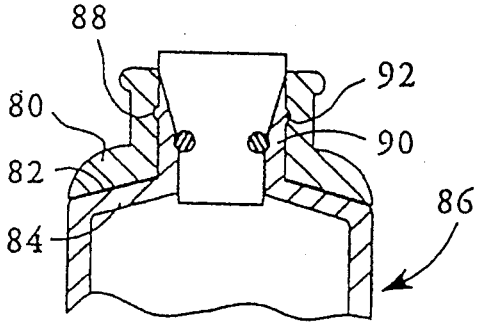
FIG. 6 is a sectional view showing yet another spacer and tube in accordance with yet another embodiment of the present invention.

The previous embodiments refers to centrifuge tubes having a bell-shaped top portion. The present invention is equally applicable to hemi-spherical top or cone top centrifuge tubes. As shown in FIG. 5, spacer 60 has a hemi-spherical concave surface 62 matching the hemi-spherical convex top 64 of the centrifuge tube 66. In accordance with the present invention, the spacer 60 is provided with an annular groove 68 and the tube stem 70 is provided with an annular ridge 72 to form an interlocking coupling. As shown in FIG. 6, spacer 80 has a conical surface 82 matching the conical top 84 of the centrifuge tube 86. In accordance with the present invention, the spacer 80 is provided with an annular groove 88 and the tube stem 90 is provided with an annular ridge 92 to form an interlocking coupling.

Figure 7:
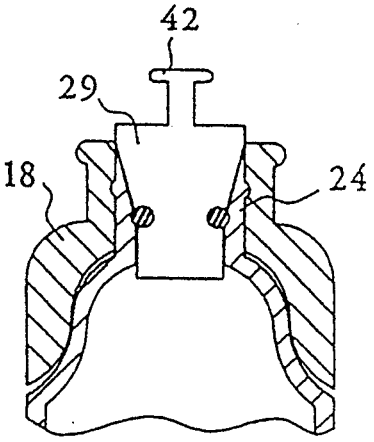
FIG. 7 is another embodiment of a plug to be used with a centrifuge tube to take advantage of the spacer of the present invention.

FIG. 7 shows a variation of the plug of the previous embodiment which has a flange 42 extending from the top of the plug 29. Post centrifugation and extractions of the tube from the rotor cavity and spacer 18 from the tube stem 24. The plug 29 can be removed from the tube stem 24 by applying an extraction tool to grip the flange 42 to pull the plug 29 out of the tube stem 24.

Figure 8:
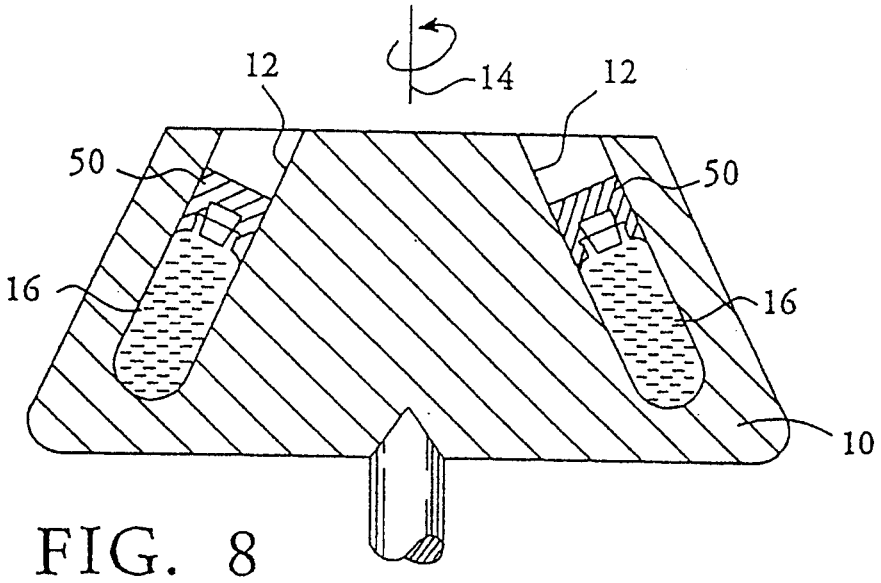
FIG. 8 is a schematic view of a fixed angle rotor carrying a centrifuge tube and spacer in accordance with the present invention.

As schematically shown in FIG. 8, a fixed angle centrifuge rotor 10 has a plurality of circumferentially spaced cylindrical cavities 12 each adapted to retain a fluid sample during centrifugation. The cavities 12 are at an oblique angle with respect to the spin axis 14 of the rotor 10. With this configuration, the horizontally activating centrifugal force has components acting both laterally and axially in each cavity. Inserted in the cavity 12 is a sample containing tube 16 and a floating spacer 50 engaging the top of the tube. The spacer is free to move along the cavity except for the interaction with the tube and the frictional contact between the spacer and the cavity.

Figure 9:
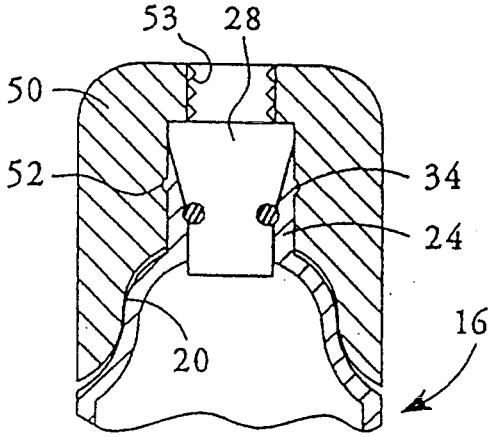
FIG. 9 is a sectional view of the spacer for used in fixed angle rotor in accordance with the present invention.

Referring to FIG. 9, the spacer 50 suitable for use in fixed angle rotors is more clearly shown. The spacer 50 is similar to the spacer described in U.S. Pat. No. 4,304,356, except for the provision of an annular groove 52 for interlocking to the annular ridge 34 on the tube stem 24, and a tube conforming profile adapted to receive the tube stem 24 and plug 28. A threaded hole 53 is provided just large enough for a threaded tool to be used for removal of the spacer from the rotor cavity. The preferred profile of the top portion 20 of the tube, and thus the tube conforming profile of the spacer, is bell-shaped for the specific application in fixed angle rotors.

Without the spacer 50 in the fixed angle rotor, the centrifugal force would deform the unsupported top portion 20 and tube stem 24 of the tube 16. In addition, for the particular application in a fixed angle rotor 10 shown in FIG. 8, the high internal hydrostatic pressure from the centrifugation may rupture the top portion 20. It is noted that for ultracentrifugation at which the rotor rotates at over 30,000 rpm, the hydrostatic pressure developed in the tube 16 can be quite significant. For example in a particular rotor, over 500,000 g is created at 70,000 rpm, developing a hydrostatic pressure on the order of 8,000 psi. The spacer 50 which is shaped to conform to the profile of the top of the tube 16 provides support to the top of the tube against not only the internal hydrostatic pressure against the top portion 20, but also the deforming centrifugal force acting on the top portion 20 and the tube stem 24. Under the component of the centrifugal force acting along the cavity 12, the spacer will "float" in the cavity, to the extent to maintain supporting engagement with the top of the tube. While the spacer 50 is interlocked to the tube stem 24, the spacer 50 will move with respect to the cavity to mate tightly against the surface of the top portion 20 under the high centrifugal force component. These and other advantages of the spacer 50 are also disclosed in U.S. Pat. No. 4,304,356.

The bell-shaping of the spacer 50 concentrates the majority of deformation in that area thereby reducing the wedging effect and lowering the extraction force necessary to remove the tube from the rotor (by use of a suitable extraction device not shown, e.g. a tweezers as disclosed in copending application No. 08/042,352.) In order words, the bell-shaping allows control of location of deformation, since deformation cannot be prevented. The bell-shaping also lowers the center of gravity of the spacer 50 compared to the center of gravity of the tube stem. The center of gravity of the spacer 50 is closer to the center of gravity of the tube stem 24, thus eliminating or decreasing the effect of clockwise rotation about the tube stem. This decreases or eliminates the spacer lift which occurs on the radially inward side of the tube 16. Consequently, this allows more restraining force to be loaded downward against the top of the tube for support during centrifugation.

It has been found that for fixed angle rotor applications, the annular interlocking structure describe above may be omitted for self-seal tubes similar to the OptiSeal TM tubes.

While the present invention has been described with respect to the illustrated embodiments in accordance therewith, it will be apparent to those skilled in the art that various modifications and improvements may be made without departing from the scope and spirit of the invention. Accordingly, it is to be understood that the invention is not to be limited by the specific illustrated embodiments, but only by the scope of the appended claims.

I claim:

1. In a centrifuge of the type having a spin axis at an angle to the axis of tubes supported in a walled cavity for rotation about the spin axis, the combination comprising, an axially symmetric tube for holding fluids for centrifugation in a walled rotor cavity structure, the tube having a cylindrical body portion tapering to a narrower top portion including having an stem annular ridge, outwardly extending having a rounded cross-section, a cylindrical self-registering spacer member coaxially surrounding the external periphery of the top portion of the tube, the spacer member having an axially inward profile generally following the profile of the top portion of the tube, including providing a snap fit therebetween said annular ridge a groove having a rounded cross-section for receiving, and having an outward profile generally following the wall of said cavity structure, the spacer member separating the tube from the walled cavity in a floating state when the centrifuge is at rest but wedging the spacer between the cavity wall and the tube when the centrifuge is rotating, whereby the top portion of the tube is supported during centrifugation.

2. The combination recited in claim 1 wherein said spacer has a recess for receiving a plug.

3. The combination recited in claim 2 wherein said spacer has a threaded hole for receiving a threaded tool to be used for removing the spacer from a rotor cavity structure.

4. The combination recited in claim 1 wherein said profile is substantially hemispherical in shape.

5. The combination recited in claim 4 wherein said spacer has a through portion for allowing said stem to extend therethrough.

6. The combination recited in claim 4 wherein said spacer has a recess for receiving a plug.

7. The combination recited in claim 6 wherein said spacer has a threaded hole for receiving a threaded tool to be used for removing the spacer from the a rotor cavity structure.

8. The combination recited in claim 1 wherein said profile is bell-shaped.

9. The combination recited in claim 8 wherein said spacer has a through portion for allowing said stem to extend therethrough,

10. The combination recited in claim 8 wherein said spacer has a recess for receiving a plug.

11. The combination recited in claim 10 wherein said spacer has a threaded hole for receiving a threaded tool to be used from removing the spacer from a rotor cavity structure.

12. The combination recited in claim 1 wherein said spacer has a through portion for allowing said stem to extend therethrough.

* * * * *